US005189334A

United States Patent [19]

Park

[11] Patent Number: 5,189,334

[45] Date of Patent: Feb. 23, 1993

[54] CATHODE RAY TUBE HAVING SHADOW MASK

[75] Inventor: Hae-kyun Park, Pusan, Rep. of Korea

[73] Assignee: Samsung Electronic Devices Co., Ltd., Kyunggi-do, Rep. of Korea

[21] Appl. No.: 876,071

[22] Filed: Apr. 28, 1992

Related U.S. Application Data

[63] Continuation-in-part of Ser. No. 607,659, Nov. 1, 1990, abandoned.

[30] Foreign Application Priority Data

Nov. 2, 1989 [KR] Rep. of Korea ..... 89-16178

[51] Int. Cl.[5] ..... H01J 29/07

[52] U.S. Cl. ..... 313/402; 313/407

[58] Field of Search ..... 313/402, 407

[56] References Cited

U.S. PATENT DOCUMENTS

| | | | |
|---|---|---|---|
| 3,855,493 | 12/1974 | Snook et al. | 313/402 |
| 4,437,036 | 3/1984 | Ragland, Jr. | 313/402 |
| 4,562,377 | 12/1985 | Kamohara et al. | 313/402 |

FOREIGN PATENT DOCUMENTS

| | | | |
|---|---|---|---|
| 197636 | 11/1983 | Japan | 313/402 |
| 62-096250 | 6/1987 | Japan . | |
| 92-001571 | 3/1992 | Rep. of Korea . | |
| 1230891 | 5/1971 | United Kingdom . | |
| 1313071 | 4/1973 | United Kingdom . | |
| 2000905 | 1/1979 | United Kingdom . | |

*Primary Examiner*—Palmer C. DeMeo

*Attorney, Agent, or Firm*—Cushman, Darby and Cushman

[57] ABSTRACT

A shadow mask for use in a color cathode ray tube includes an electron beam transmissive domed plane disposed substantially perpendicular to an electron beam path. The domed plane comprises a central apertured area which has a predetermined pattern of electron beam transmissive apertures chemically etched thereon. An unapertured border is formed along the periphery of the central apertured border and a skirt portion is formed along the periphery of the unapertured border. The skirt portion and the unapertured order include a plurality of stripe type grooves which are formed on top and bottom surfaces of both the unapertured border and the skirt portion and which are alternately configured and formed by a chemical etching process. The chemically etched plurality of stripe type grooves are provided to eliminate the problem of spring-back when the domed plane is press-formed into a domed shape.

2 Claims, 2 Drawing Sheets

CATHODE RAY TUBE HAVING SHADOW MASK

This is a continuation-in-part of U.S patent application Ser. No. 07/607,659 filed Nov. 1, 1990, now abandoned.

BACKGROUND OF THE INVENTION

1. Field of the Invention

The present invention relates to a cathode-ray tube having an improved shadow mask adapted to effectively suppress spring-back phenomena occurring in the skirt portion thereof.

2. Background Information

A shadow mask is typically suspended within a cathode-ray tube envelope and positioned adjacently to a phosphor screen on the inner surface of a panel. The shadow mask functions as a color selection electrode which filters the scanning electron beams projected from an electron gun, incorporated in the neck of a funnel, toward the phosphor screen.

The conventional shadow mask 10 depicted in FIG. 1 comprises central apertured area 12 having a pattern of electron beam transmissive apertures 11, unapertured border 13 surrounding central apertured area 12, skirt portion 13*a* formed along the periphery of unapertured border 13 and positioned substantially perpendicular to central apertured area 12, and ridge 14 formed along the periphery of the central apertured area 12 in unapertured border 13. Ridge 14 is provided for reinforcing shadow mask 10. Skirt portion 13 serves as a welding portion for attaching shadow mask 10 to frame 20.

Shadow mask 10 has a scooped surface as shown in FIG. 2 and is formed by a press-forming process using a flat thin blank of metal. The press-forming process is accomplished by drawing the blank of metal consisting of central apertured area 12 together with unapertured border 13 into a domed shape and bending the periphery of unapertured border 13 to form skirt portion 13*a*. Here, the aforesaid steps are successively performed by one press machine.

However, a shadow mask formed by this press-forming process has a problem. A spring-back phenomena generally occurs in the shadow mask because a complete plastic deformation is not achieved in press-forming the bent portion.

The spring-back phenomena occurs chiefly in the skirt portion making it difficult to accurately weld the shadow mask to a frame because there is loose contact between the two surfaces.

When the skirt portion and the frame are widely gaped and forcibly welded together, the skirt portion becomes partially deformed causing the central apertured area and the unapertured border to become distorted.

The central apertured area which has a plurality of electron beam passing apertures is extremely fragile in structure in comparison with the unapertured border or the skirt portion. The central apertured area is therefore easily distorted causing the electron beam transmissive apertures to become misarranged. As a result, the filtering of electron beams through the electron beam transmissive apertures is not accurately performed, thereby degenerating the color purities of the screen image formed on the phosphor screen.

SUMMARY OF THE INVENTION

Therefore, it is the object of the present invention to provide a cathode-ray tube having an improved shadow mask which is adapted to remarkably suppress spring-back phenomena and prevent the cathode-ray tube from degenerating the color purities.

To accomplish the above object, the present invention provides a color cathode-ray tube having an improved shadow mask including an electron beam transmissive domed plane formed substantially perpendicular to an electron beam path. The domed plane has a central apertured area with a pattern of electron beam transmissive apertures and an unapertured border, and a skirt portion formed along the periphery of the unapertured border. A plurality of stripe type grooves are formed on both top and bottom surfaces of the unapertured border and the skirt portion so that the grooves on the top surface and the grooves on the bottom surface of the unapertured border and the skirt portion are alternately disposed thereby eliminating any spring-back phenomena occurring in the skirt portion after a press-forming process.

BRIEF DESCRIPTION OF THE DRAWINGS

The invention, together with further objects and advantages thereof, may be better understood by reference to the following description taken in conjunction with the accompanying drawings, in which.

DETAILED DESCRIPTION OF THE INVENTION

Figure 1:
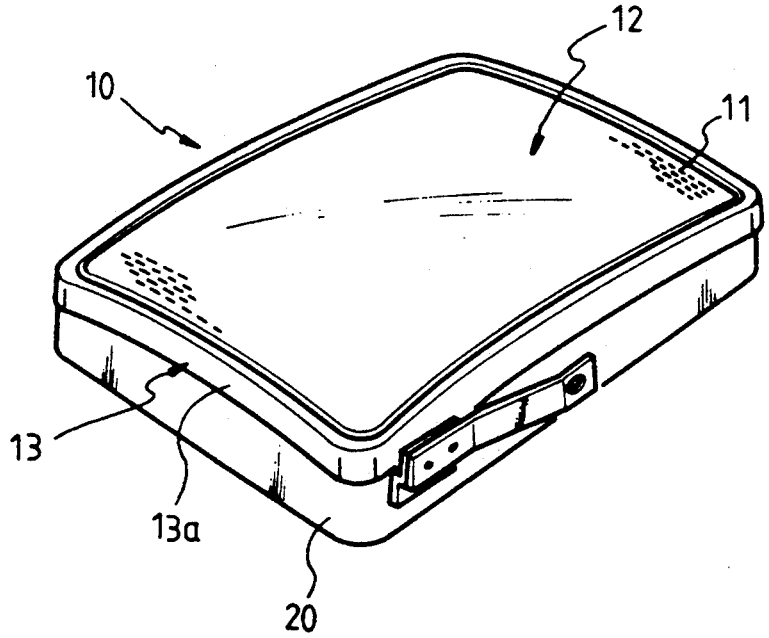
FIG.1 (Prior Art)
FIG. 1 is a schematical perspective view of a conventional shadow mask attached to a frame for supporting the shadow mask.
Figure 2:
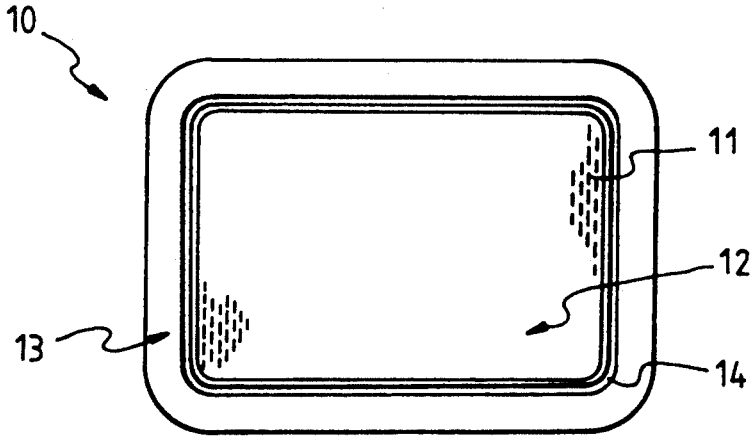
FIG.2 (Prior Art)
FIG. 2 is a plan view of the blank of the shadow mask shown in FIG. 1 prior to a press-forming process.
Figure 3:
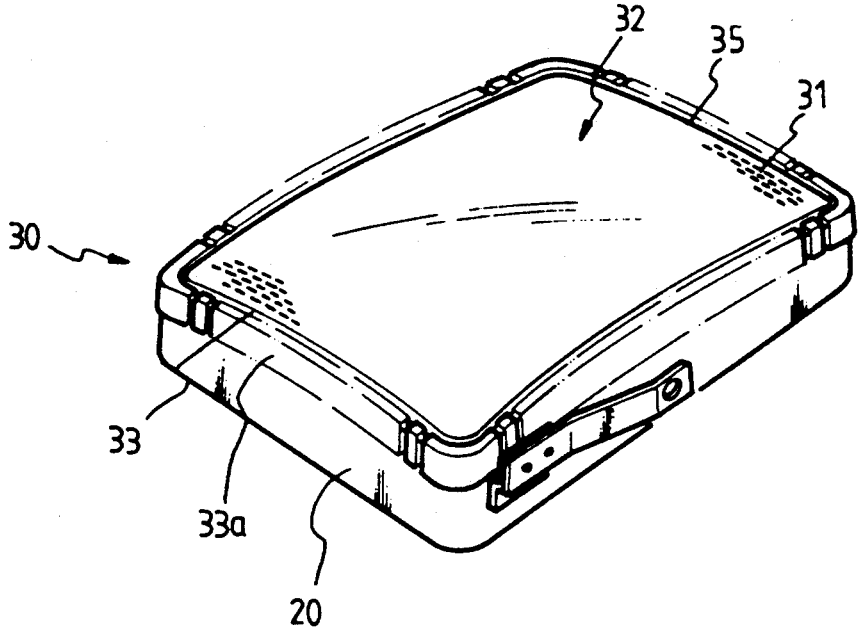
FIG. 3 is a perspective view of the shadow mask according to the present invention attached to a frame for supporting the shadow mask.

FIG. 3 shows shadow mask 30 according to the present invention which is attached to a frame.

Shadow mask 30 which is similar to a conventional shadow mask comprises an electron beam transmissive domed plane which will be disposed substantially perpendicular to an electron beam path. Shadow mask 30 further includes central apertured area 32 which has a pattern of electron beam transmissive apertures 31 and unapertured border 33, skirt portion 33*a* formed along the periphery of the unapertured border 33 substantially perpendicularly to the central apertured area, and ridge 35 formed along the periphery of the central apertured area 32 in the unapertured border 33 for reinforcing shadow mask 30. Skirt portion 33*a* is an extension of unapertured border 33 and is directly welded to frame 20.

Figure 5:
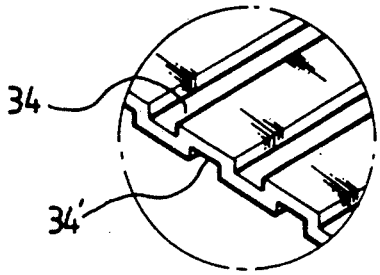
FIG. 5 is an extracted enlarged perspective view of the blank of the shadow mask shown in FIG. 4.

In one aspect of the present invention, a plurality of stripe type grooves 34 and 34' depicted in FIG. 5 are alternately formed on both top and bottom surfaces of unapertured border 33 and skirt portion 33*a* and perpendicularly oriented with respect to the periphery of central apertured area 32 or the electron beam transmissive plane.

Figure 4:
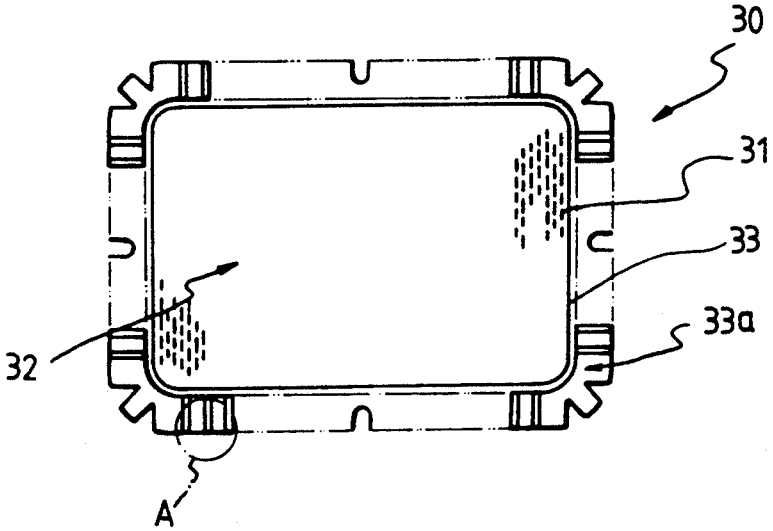
FIG. 4 is a plan view of the blank of the shadow mask shown in FIG. 3 prior to a press-forming process.

In addition, shadow mask 30 is shaped by press-forming a flat thin blank of metal which is first formed with a plurality of beam transmitting apertures 31 as depicted in FIG. 4. A plurality of stripe type grooves 34 and 34', as shown in FIG. 5, are also etched on unapertured border 33 and skirt portion 33*a* during the process of etching the pattern of electron beam transmissive apertures 31.

During the process of press-forming, the flat thin blank of metal which includes central apertured area 32 together with unapertured border 33 are formed into a domed configuration. The outer periphery of unapertured border 33 is then successively bent to form skirt portion 33*a* with the help of just one press machine.

According to the present invention, the function of stripe type grooves 34 and 34' is to provide a skirt portion and an unapertured border in shadow mask 30 that is relatively weak in mechanical strength when compared with conventional shadow masks. Unapertured border 33 and skirt portion 33*a* are easily plastically deformed thereby preventing the unfavorable occurrence of spring-back along the skirt portion.

Furthermore, stripe type grooves 34 and 34' are alternately formed on both top and bottom surfaces of skirt portion 33*a* and also disposed toward central apertured area 32, thus avoiding wrinkling of skirt portion 33*a*.

Because skirt portion 33*a* of shadow mask 30 abuts on each side surface of a frame without gap, welding of shadow mask 30 to the frame is perfectly executed preventing misalignment of electron beam transmissive apertures 31 along central apertured area 32.

Consequently, shadow mask 30, according to the present invention is easy to manufacture. Moreover, the present invention overcomes the problem of a distorted screen image in a cathode-ray tube resulting from a distorted central apertured area of a shadow mask.

The present invention has been described in specific embodiment, but it will be understood by those skilled in the art that changes and modifications can be made without departing from the scope of the present invention defined by the following claim.

What is claimed is:

1. A shadow mask for use in a color cathode ray tube and having an electron beam transmissive domed plane disposed substantially perpendicular to an electron beam path, said domed plane comprising:

a central apertured area having a predetermined pattern of electron beam transmissive apertures chemically etched therein;

an unapertured border formed along the periphery of said central apertured border; and a skirt portion formed along the periphery of said unapertured border, said skirt portion and said unapertured border comprising a plurality of chemically etched stripe type grooves formed on top and bottom surfaces of both said unapertured border and said skirt portion, said plurality of chemically etched stripe type grooves being alternately configured and provided to eliminate the problem of spring-back when the domed plane is press-formed into domed shape.

2. The shadow mask of claim 1, wherein said plurality of chemically etched stripe type grooves and said predetermined pattern of chemically etched electron beam transmissive apertures are formed during a same etching operation.

* * * * *